US008151720B2

(12) United States Patent
Turner

(10) Patent No.: US 8,151,720 B2
(45) Date of Patent: Apr. 10, 2012

(54) OPEN EYE SEWING NEEDLE

(75) Inventor: Pamela Turner, Blaine, MN (US)

(73) Assignee: PST Innovations, LLC, Blaine, MN (US)

( * ) Notice: Subject to any disclaimer, the term of this patent is extended or adjusted under 35 U.S.C. 154(b) by 138 days.

(21) Appl. No.: 12/724,142

(22) Filed: Mar. 15, 2010

(65) Prior Publication Data

US 2010/0229772 A1 Sep. 16, 2010

Related U.S. Application Data

(60) Provisional application No. 61/159,965, filed on Mar. 13, 2009, provisional application No. 61/159,844, filed on Mar. 13, 2009.

(51) Int. Cl.
*D05B 69/00* (2006.01)

(52) U.S. Cl. ..... 112/221; 223/102

(58) Field of Classification Search ..... 112/221, 112/222, 224, 223, 225–227, 49, 98, 202, 112/281, 321; 223/102; 163/1–7
See application file for complete search history.

(56) References Cited

U.S. PATENT DOCUMENTS

| | | | | |
|---|---|---|---|---|
| 102,380 | A | | 4/1870 | Donaldson et al. |
| 790,120 | A | | 5/1905 | Garrett |
| 1,054,117 | A | | 2/1913 | Henderson |
| 1,341,357 | A | | 5/1920 | Careaga |
| 2,190,792 | A | | 2/1940 | Lippard |
| 2,526,104 | A | | 10/1950 | Yamamoto |
| 2,595,758 | A | | 5/1952 | Brown et al. |
| 2,721,014 | A | * | 10/1955 | Allen ..... 223/102 |
| 2,741,409 | A | | 4/1956 | Orthwine |
| 2,872,092 | A | | 2/1959 | Sehlow |
| 3,031,116 | A | | 4/1962 | Hunter et al. |
| 3,258,938 | A | * | 7/1966 | Hofmann ..... 66/119 |
| 3,525,460 | A | | 8/1970 | Hendy |
| 3,531,030 | A | * | 9/1970 | Doiron ..... 223/102 |
| 3,581,688 | A | | 6/1971 | Ketterer |

(Continued)

FOREIGN PATENT DOCUMENTS

| | | |
|---|---|---|
| GB | 2210389 A | 6/1989 |

(Continued)

OTHER PUBLICATIONS

Easy-Threading/Calyx Eye Needle; product date unknown; shown on web page: http://www.entaco.com/products_needles.php.

*Primary Examiner* — Tejash Patel
(74) *Attorney, Agent, or Firm* — Dicke, Billig & Czaja, PLLC

(57) ABSTRACT

An open eye needle including an elongated portion, a tip portion and an open eye portion. The tip portion is attached to the elongated portion. The open eye portion is attached to the elongated portion. The open eye portion includes a tongue portion, an eye region and a channel. The eye region is defined by the tongue portion. The channel extends around the tongue portion and intersects the eye portion. The channel includes a first channel portion and a second channel portion that extends from the first channel portion. The first channel portion is oriented at an acute angle with respect to the second channel portion. The second channel portion is in communication with the eye region.

16 Claims, 2 Drawing Sheets

U.S. PATENT DOCUMENTS

| | | | | |
|---|---|---|---|---|
| 3,862,611 | A | | 1/1975 | Kuromegawa |
| 4,385,575 | A | | 5/1983 | Weber |
| 4,539,923 | A | | 9/1985 | Long |
| 5,038,836 | A | * | 8/1991 | Caramaschi ..... 139/11 |
| 5,129,558 | A | | 7/1992 | Feuerman |
| D467,726 | S | | 12/2002 | Zaniewski et al. |
| D492,477 | S | | 7/2004 | Zaniewski et al. |
| 2009/0039117 | A1 | | 2/2009 | Mashiko et al. |

FOREIGN PATENT DOCUMENTS

| | | | |
|---|---|---|---|
| GB | 2353047 | A | 2/2001 |
| WO | 0158324 | A1 | 8/2001 |

* cited by examiner

OPEN EYE SEWING NEEDLE

REFERENCE TO RELATED APPLICATIONS

This application claims priority to U.S. Provisional Application No. 61/159,965 entitled OPEN EYE SEWING MACHINE NEEDLE, which was filed on Mar. 13, 2009 and U.S. Provisional Application No. 61/159,844 entitled OPEN EYE HAND SEWING NEEDLE, which was filed on Mar. 13, 2009, the contents of which are incorporated herein by reference.

FIELD OF THE INVENTION

The invention relates generally to needles. More particularly, the invention relates to open eye needles.

BACKGROUND OF THE INVENTION

Sewing needles can be used in conjunction with thread to sew together various types of materials. One of the prerequisites of using sewing needles and one of the greatest challenges of using sewing needles is feeding thread through the eye of the sewing needle.

Various devices have been developed to assist in feeding thread through the eye of the sewing needle. One such device includes a handle from which a loop made from a thin metal wire extends. The rigidity of the loop enhances the ability to pass the loop through the eye when compared to thread.

The loop narrows as it is passed through the sewing needle eye and then expands so that the thread can be readily passed therethrough. Pulling the handle away from the sewing needles thereby pulls the thread through the sewing needle eye.

While these threading devices are very helpful to enhance the ability to feed thread through the sewing needle eye, these devices are separate from the sewing needle. As such, these threading devices must be stored in a location where they will not be lost but which enables the threading devices to be readily accessed.

SUMMARY OF THE INVENTION

An embodiment of the invention is directed to an open eye needle having a tip portion, an open eye portion, and an elongated portion that is located intermediate the tip portion and the open eye portion. This configuration enables the open eye needle to be used in conjunction with hand sewing.

Another embodiment of the invention is directed to an open eye needle having a tip portion, an open eye portion, an elongated portion and a mounting portion. This configuration enables the open eye needle to be used in conjunction with a sewing machine.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 2:
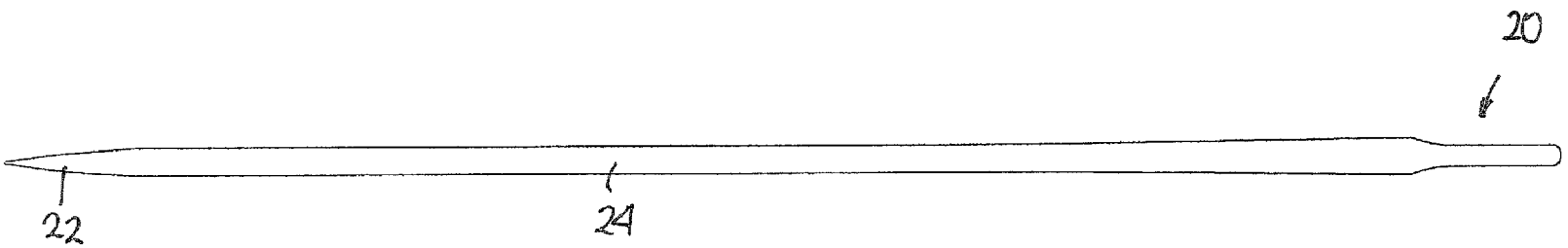
FIG. 2 is a top view of the open eye needle of FIG. 1.

An embodiment of the invention is directed to an open eye needle as illustrated at 10 in the Figures. The open eye needle 10 generally includes an open eye portion 20, a tip portion 22 and an elongated portion 24. The open eye needle 10 is adapted for use in conjunction with a thread 12 and a material 14 on which it is desired to use the open eye needle 10 and the thread 12.

The open eye needle 10 enables the thread 12 to be readily placed in the open eye portion 20. The open eye needle 10 thereby is easier to thread than conventional needles that do not include the open eye portion 20 where an end of the thread 12 must be directed through the closed eye.

The open eye needle 10 of this invention thereby permits a person with reduced eye sight and/or reduced finger dexterity to place the thread 12 into the needle eye such that these persons may sew. The open eye needle 10 also makes it easier for persons without the preceding physical limitations to place the thread 12 into the needle eye such that there are fewer frustrations with sewing.

The elongated portion 24 or shaft may be located intermediate the open eye portion 20 and the tip portion 22. The open eye needle 10 may be formed with a length that depends on the material 14 with which the open eye needle 10 is to be used. In certain embodiments, the open eye needle 10 has a length of between about 1 and 3 inches. In other embodiments, the open eye needle 10 has a length of about 1.25 inches.

The thread 12 that is used in conjunction with the open eye needle 10 may be formed with a variety of diameters. In certain embodiments, the thread 12 used in conjunction with the open eye needle 10 may have a diameter of about 0.005 inches.

To facilitate extending the open eye needle 10 through the material 14 while minimizing the potential of the open eye needle 10 snagging on the material 14, the open eye portion 20 may have a diameter that is no wider than a diameter of the other portions of the open eye needle 10.

In other embodiments, a portion of the open eye needle 10 that is between the open eye portion 20 and the top portion 22 has a diameter that is greater than a diameter of the open eye portion 20. In still other embodiments, the wider region is immediately adjacent to the open eye portion 20 but between the open eye portion 20 and the tip portion 22.

Forming the open eye needle 10 in this manner causes the hole in the fabric through which the open eye needle 10 is extending to be stretched. This configuration thereby reduces the likelihood of the open eye needle 10 snagging on the material 14 while passing through the material 14.

A difference in the diameter of a wider region and the open eye portion 20 depends on a variety of factors. One such factor is a tightness of a weave of the material 14 through which the open eye needle 10 is used. In certain embodiments, the wide region has a diameter that is up to about 30% greater than a diameter of the open eye portion 20. In other embodiments, the wide region has a diameter that is between about 1 and 10% wider than a diameter of the open eye portion 20.

The open eye portion 20 may include an eye region 30 that is at least partially covered by a tongue portion 32. An end 34 of the tongue portion 32 that is opposite the point of attachment to the open eye needle 10 may be angled inwardly away from an outer surface of the open eye needle 10. Orienting the tongue portion 32 in this manner reduces the potential of the tongue portion 32 catching as the open eye needle 10 passes through the material 14.

Depending upon the material from which the open eye needle 10 is formed and/or the material from which the open eye portion 20 is formed, the tongue portion 32 may deflect to pass the thread 12 into the channel 36. The tongue portion 32 may be formed from a resilient material that enables the tongue portion 32 to return to an initial configuration after a force that is causing the tongue portion 32 to deflect is discontinued.

When the tongue portion 32 is formed from a resilient material, the channel 36 may be substantially closed such that a distance between opposite side walls of the channel 36 is less than a diameter of the thread 12. In certain embodiments, the channel 36 is completely closed when the tongue portion 32 is in an initial position. Forming the tongue portion 32 with these properties may reduce the potential of the thread 12 inadvertently passing through a channel 36 to become detached from the open eye needle 10.

The channel 36 is thereby defined that extends around the tongue portion 32 and intersects the eye region 30. The channel 36 is the path through which the thread 12 is passed to move into the eye region 30 and thereby be attached to the open eye needle 10.

Since it is desirable for the open eye needle 10 to have the greatest possible strength, the channel 36 should have the smallest width possible while permitting the thread 12 to move through the channel 36. However, the channel 36 should be sufficiently wide to permit the thread 12 to pass through the channel 36 without being restricted by contact with opposite walls of the channel 36.

To facilitate placing the thread 12 into the open eye needle 10, the channel 36 may have a width of about 0.007 inches proximate a surface of the open eye needle 10. A width of the channel 36 proximate a tip of the tongue portion 32 may be narrower than the width of the channel 36 proximate the surface of the open eye needle 10. In certain embodiments, the width of the channel 36 proximate the tip of the tongue portion 32 may be about 0.004 inches.

The channel 36 may include first channel portion 36*a* and a second channel portion 36*b* that extends from and is operably connected to the first channel portion 36*a*. The first channel portion 36*a* is located proximate an exit 37 on the channel 36. The second channel portion 36*b* is located proximate an entrance to the eye region 30.

The first channel portion 36*a* may be oriented at an angle with respect to the second channel portion 36*b*. In certain embodiments, an angle between the first channel portion 36*a* and the second channel portion 36*b* is an acute angle. In other embodiments, the angle between the first channel portion 36*a* and the second channel portion 36*b* is between about 5° and 45°.

Forming the channel 36 with this configuration reduces the potential of the thread 12 inadvertently passing through the channel 36 when the open eye needle 10 is used such that the thread 12 detaches from the open eye needle 10.

The second channel portion 36*b* may be oriented at an angle with respect to the eye region 30. In certain embodiments, an angle between the second channel portion 36*b* and the eye region 30 is an obtuse angle. In other embodiments, an angle between the second channel portion 36*b* and the eye region 30 is between about 130° and 170°.

Forming the channel 36 with this configuration reduces the potential of the thread 12 inadvertently passing from the eye region 30 to the channel 36 when the open eye needle 10 is used such that the thread 12 detaches from the open eye needle 10.

A width of the channel 36 intermediate the tip of the tongue portion 32 and the eye region 30 may be slightly larger than a width of the thread 12 that is to be used with the open eye needle 10. In certain embodiments, the width of the channel 36 intermediate the tip of the tongue portion 32 and the eye region 30 may be about 0.005 inches.

To further reduce the potential of the thread 12 inadvertently coming out of the eye region 30 through the channel 36, a tab 38 may extend from a surface of the open eye portion 20 that is opposite the tongue portion 32. In certain embodiments, the channel 36 may have a width proximate the tab 38 that is slightly larger than the width of the thread 12.

The open eye portion 20 may also include an extension 40 that at least partially extends over the tongue portion 32. The extension 40 resists material weave through which the open eye needle 10 is extended from dropping into the channel 36. This configuration thereby enhances the ability to use the open eye needle 10 with a variety of types of material. A width of the channel 36 proximate the extension 40 may be slightly larger than the width of the thread 12.

In certain embodiments, the eye region 30 may have a generally oval configuration such that the thread 12 that is placed in the eye region 30 may freely move with respect to the eye region 30. This configuration reduces the potential of the thread 12 weakening where the thread 12 extends through the eye region 30.

A length and a width of the eye region 30 may be selected based upon the diameter of the thread 12 that is to be used in conjunction with the open eye needle 10. The length and the width of the eye region 30 may each be greater than the diameter of the thread 12 that is to be used in conjunction with the open eye needle 10.

In certain embodiments, the width of the eye region 30 may be between about 0.005 and 0.020 inches. In other embodiments, the width of the eye region 30 may be about 0.007 inches.

In certain embodiments, the length of the eye region 30 may be between about 0.005 and 0.030 inches. In other embodiments, the length of the eye region 30 may be about 0.015 inches. In certain embodiments, the length of the eye region 30 is larger than the width of the eye region.

To accommodate the open eye portion 20 while retaining the strength of the open eye needle 10 such that the open eye needle 10 resists deformation or breakage during use, a width and/or thickness of the open eye portion 20 may be greater than a width and/or thickness of the other portions of the open eye needle 10.

To facilitate passing the open eye needle 10 through the material 14, the width of the open eye needle 10 may gradually increase proximate the open eye portion 20. In certain embodiments, the open eye portion 20 has a width of between about 0.20 and 0.40 inches. In other embodiments, the width of the open eye portion 20 is about 0.30 inches.

While the other parts of the open eye needle 10 may be generally cylindrical, the open eye portion 20 may be non-cylindrical. In certain embodiments, areas of the open eye portion 20 may have an oval profile. In certain embodiments, the elongated portion 24 may have a diameter of about 0.028 inches while the open eye portion 20 may have a width of about 0.030 inches and a height of about 0.025 inches.

Figure 3:
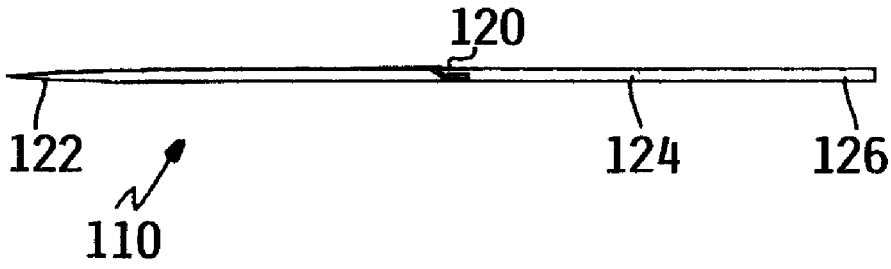
FIG. 3 is a side view of an open eye needle according to another embodiment of the invention, which is particularly adapted for use in conjunction with a sewing machine.
Figure 4:
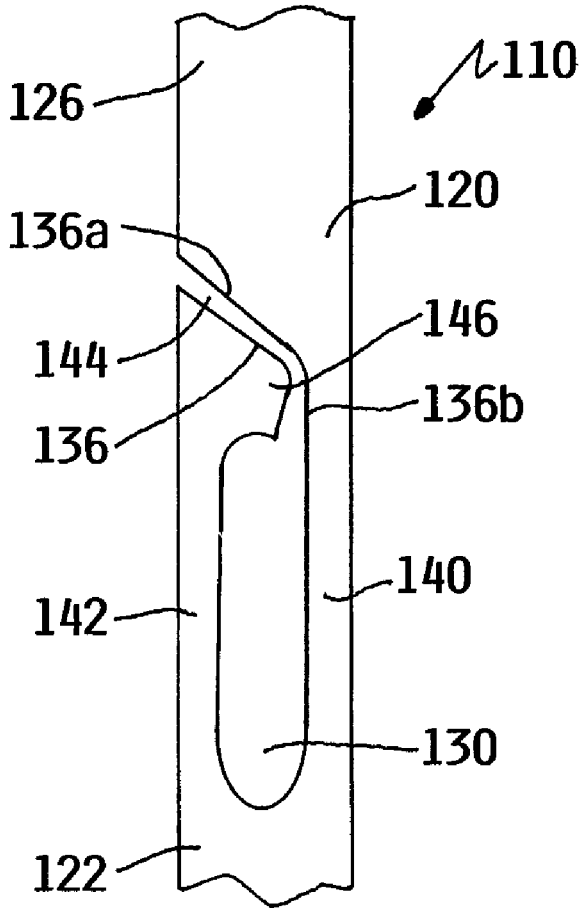
FIG. 4 is an enlarged side view of the open eye needle of FIG. 3.

The top and bottom surface of the open eye portion 20 may have a recess 44 formed therein, as illustrated by the shaded areas in FIG. 3. In certain embodiments, the recess 44 may extend from an end of the open eye needle 10 to proximate a lower end of the channel 36. In certain embodiments, the recess 44 may have a width of about 0.005 inches and a depth of about 0.0025 inches.

The recess 44 may be adapted to receive at least a portion of the thread 12 to decrease an overall size of the thread 12 and open eye needle 10 when the open eye needle 10 is extended through the material 14. This configuration thereby reduces the force needed to push the open eye needle 10 and the thread 12 through the material 14.

The open eye portion 20 may comprise between about 5 and 30 percent of the length of the open eye needle 10. In certain embodiments, the open eye portion 20 comprises between about 10 and 15 percent of the length of the open eye needle 10.

The tip portion 22 is tapered to a point 48. A length of the taper and a width of the point 48 may be selected based upon the type of material 14 with which the open eye needle 10 is to be used. For example, when the material 14 is woven fabric having a relatively fine thread count, the point 48 may have a relatively small width.

The tip portion 22 may comprise between about 10 and 30 percent of the length of the open eye needle 10. In certain embodiments, the tip portion 22 comprises between about 15 to 20 percent of the length of the open eye needle 10.

The elongated portion 24 may have a generally cylindrical shape and may be formed with a length that enables the open eye needle 10 to be initially pushed through the material 14 from an upper side of the material 14 and then pulled through the material 14 from a lower side of the material 14. It is possible for the elongated portion 24 to take alternate shapes, examples of which include oval and hexagon.

The elongated portion 24 may comprise between about 50 and 80 percent of the length of the open eye needle 10. In certain embodiments, the elongated portion 24 comprises between about 60 and 70 percent of the length of the open eye needle 10.

The open eye needle 10 may be fabricated from a variety of materials, examples of which include metal and plastic. A preferred material for fabricating the open eye needle 10 is stainless steel, which is strong and resists corrosion during use and storage. In certain embodiments, the stainless steel used to fabricate the open eye needle 10 is 174PH and 177PH.

In certain embodiments, the open eye needle 10 is fabricated from a single piece of material having a consistent composition throughout. In other embodiments, the open eye needle 10 may be fabricated from more than one material that is joined together to fabricate the open eye needle. These different materials may be selected to provide the individual components of the open eye needle 10 with optimal performance.

For example, the top portion 48 may be fabricated from a harder material than the other components of the open eye needle 10. Alternatively or additionally, the open eye portion 20 may be fabricated from a resilient material that allows the tongue portion 32 to deflect such as when the thread 12 is being placed into the open eye portion 32.

In certain embodiments, the open eye needle 10 is shaped, hardened and sharpened. The open eye needle 10 may also be annealed depending on the material used to fabricate the open eye needle 10. Examples of techniques that may be used to fabricate the open eye needle 10 include stamping, laser, EDM or combinations thereof.

After forming, the open eye needle 10 may be hardened by heating. The temperature and duration needed to achieve hardening of the open eye needle 10 depends on the material used to fabricate the open eye needle 10.

Next, the open eye needle 10 is sharpened. A person of ordinary skill in the art will appreciate that a variety of techniques may be used to sharpen the open eye needle 10 such as grinding and polishing.

Thereafter, one or more coatings may be applied to the surface of the open eye needle 10. Examples of such coatings include titanium on the tip portion 22 to enhance the durability of the tip portion 22, gold plating to the open eye portion 20 to allow the thread 12 to pass through the open eye portion 20 more easily. It is also possible to coat the surface of the open eye needle 10 with nickel. Examples of other coating materials include silicon or similar materials.

In use, an intermediate portion of the thread 12 is positioned adjacent to an open end of the channel 36. The thread 12 is then slid through the first channel portion **36*a* and then the second channel portion 36*b* until the thread 12 is positioned in the eye region 30. While the open eye needle 10 is used to pass the thread 12 through the material 14, the thread 12 is permitted to move within the eye region 30 but is retained in the eye region by the tab 38**.

Even if the thread 12 is able to pass into the channel 36, the shape and orientation of the first channel portion **36*a* and the second channel portion 36*b* restricts the ability of the thread 12 to inadvertently pass all the way through the channel 36 and thereby become detached from the open eye needle 10**.

As the eye region 30 of the open eye needle 10 is passing through the material 14, the extension 40 resists the material falling into the channel 36 and thereby snagging on the channel 36. Additionally, the wide region adjacent to the open eye region 20 reduces the potential of the material 14 falling into the channel 36 and thereby snagging on the channel 36.

While the open eye needle 10 disclosed in this embodiment is described for use in conjunction with sewing on fabric material, it is possible for the concepts of the invention to be utilized in other applications. Examples of such alternative applications include sewing done in conjunction with crafts such as attaching together beads to form jewelry. It is also possible to use the open eye needle in conjunction with medical applications such as sewing incisions.

When using the open eye needle in alternative applications, it is possible for the elongated portion 24 to have a variety of shapes. For example, the elongated portion 24 may be semicircular or S-shaped.

As an alternative to using the open eye needle 10 in conjunction with thread 12, it is possible to use the open eye needle 10 in conjunction with a variety of alternative elongated materials. An example of a few such suitable elongated materials that may be used in conjunction with the open eye needle 10 include yarn and fishing line.

Another embodiment of the invention is particularly suited for use in a sewing machine. The open eye needle 110 generally includes an open eye portion 120, a tip portion 122, an elongated portion 124 and a mounting portion 126, as illustrated in FIG. 3. The open eye needle 110 is adapted for use in conjunction with a thread 112 and a material 114 on which it is desired to use the open eye needle 110 and the thread 112.

The open eye needle 110 enables a thread 110 to be readily placed in the open eye portion 120. The open eye needle 10 thereby is easier to thread than conventional needles that do not include the open eye portion 120 where an end of the thread 12 must be directed through the closed eye.

The open eye needle 110 of this invention thereby permits a person with reduced eye sight and/or reduced finger dexterity to place the thread 112 into the needle eye such that these persons may sew. The open eye needle 110 also makes it easier for persons without the preceding physical limitations to place the thread 112 into the needle eye such that there are fewer frustrations with sewing.

The open eye portion 120 is located proximate an intermediate location on the open eye needle to facilitate using the open eye needle 110. The mounting portion 126 may be mounted opposite the tip portion 122. These features enable the open eye needle 110 to be used in a conventional sewing machine.

The open eye needle 110 may be formed with a length that depends on the materials with which the open eye needle 110 is to be used. In certain embodiments, the open eye needle 110 has a length of between about 1 and 3 inches. In other embodiments, the open eye needle 110 has a length of about 1.25 inches.

The thread 112 that is used in conjunction with the open eye needle 110 may be formed with a variety of diameters. In certain embodiments, the thread 112 used in conjunction with the open eye needle 110 may have a diameter of about 0.005 inches.

To facilitate extending the open eye needle 110 through the material 114 while minimizing the potential of the open eye needle 110 snagging on the material 114, the open eye portion 120 may have a diameter that is no wider than a diameter of the other portions of the open eye needle 110.

The open eye portion 120 may be defined by a first section 140 and a second section 142. The first section 140 extends between and interconnects the tip portion 122 and the mounting portion 126 that facilitates attachment of the open eye needle 110 to a sewing machine.

The first section 40 and the second section 42 are oriented in a spaced-apart configuration to define an eye region 30. While not illustrated, an unattached end of the second section 42 may be inwardly directed. To enhance the ability to retain thread in the eye region 130, an extension 146 may be provided on the second section 142 that extends to proximate the first section 140 to at least partially close the eye region 130.

Depending upon the material from which the open eye needle 110 is formed and/or the material from which the open eye portion 120 is formed, the second section 142 may deflect to pass thread into the channel 144.

A channel 144 is defined proximate a free end of the second section 142. The channel 144 may be oriented at an angle with respect to an outer surface of the second section 142. In certain embodiments, the angle is between about 10 and 80 degrees. In other embodiments, the angle is about 60 degrees. While the channel 144 is illustrated as being oriented towards the mounting portion 126, it is also possible to configure the open eye needle 110 so that the channel 144 is proximate the tip portion 122.

The channel 136 may be formed with a first channel portion **136*a* and a second channel portion 136*b* that extends from and is operably connected to the first channel portion 136*a*. The first channel portion 136*a* is located proximate an exit 138 on the channel 136. The second channel portion 136*b* is located proximate an entrance to the eye region 130**.

The first channel portion **136*a* may be oriented at an angle with respect to the second channel portion 136*b*. In certain embodiments, an angle between the first channel portion 136*a* and the second channel portion 136*b* is greater than about 90°. In other embodiments, an angle between the first channel portion 136*a* and the second channel portion 136*b*** is between about 90° and 135°.

Forming the channel 136 with this configuration reduces the potential of the thread 112 inadvertently passing through the channel 136 when the open eye needle 110 is used such that the thread 112 detaches from the open eye needle 110.

Figure 1:
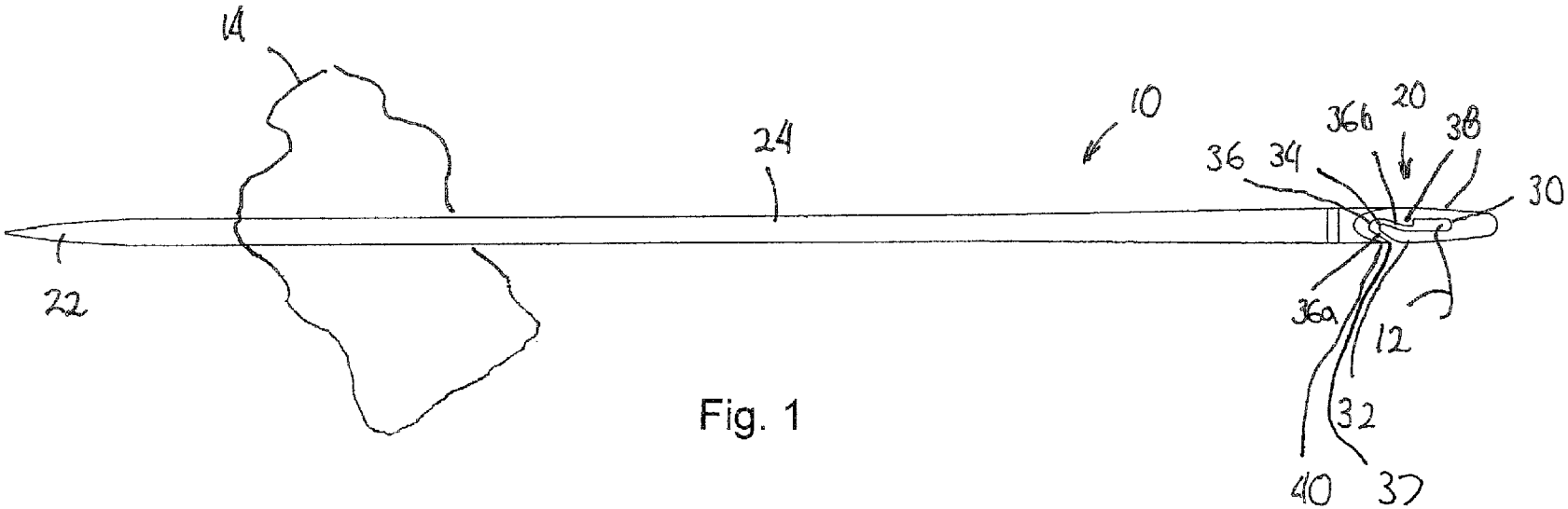
FIG. 1 is a side view of an open eye needle according to an embodiment of the invention, which is adapted for use in hand sewing.

Even though the second channel portion **136*b* is illustrated as being oriented substantially parallel to the eye region 130, the second channel portion 136*b* may be oriented at an angle with respect to the eye region 130 similar to the embodiment illustrated in FIGS. 1 and 2. In certain embodiments, an angle between the second channel portion 136*b* and the eye region 30 is between about 90° and 180°. In other embodiments, an angle between the second channel portion 136*b* and the eye region 130** is between about 130° and 170°.

Forming the channel 36 with this configuration reduces the potential of the thread 112 inadvertently passing from the eye region 130 to the channel 136 when the open eye needle 110 is used such that the thread 112 detaches from the open eye needle 110.

A width of the channel 144 proximate the outer surface of the second section 142 may be up to about 0.020 inches. In certain embodiments, the width of the channel 144 proximate the outer surface of the second section 142 may be between about 0.003 and 0.010 inches. In other embodiments, the width of the channel 144 proximate the outer surface of the second section 142 may be about 0.006 inches.

A width of the channel 144 proximate an end that is opposite the outer surface of the second section 142 may be up to about 0.020 inches. In certain embodiments, the width of the channel 144 proximate the end that is opposite the outer surface of the second section 142 may be between about 0.003 and 0.010 inches. In other embodiments, the width of the channel 144 proximate the end that is opposite the outer surface of the second section 142 may be about 0.004 inches.

To further reduce the potential of the thread 112 inadvertently coming out of the eye region 130 through the channel 136, a tab (not shown) may extend from the first section 142 towards the second section 144, similar to the embodiment illustrated in FIGS. 1-2. Similar to the embodiment illustrated in FIGS. 1-2, the open eye portion 120 may also include an extension (not shown) that at least partially extends over an unattached end of the second section 144.

In certain embodiments, the eye region 130 may have a generally oval configuration such that thread 112 that is placed in the eye region 130 may freely move with respect to the eye region 130. This configuration reduces the potential of the thread 112 weakening where the thread 112 extends through the eye region 130.

A length and a width of the eye region 130 may be selected based upon the diameter of the thread 112 that is to be used in conjunction with the open eye needle 110. The length and the width of the eye region 130 may each be greater than the diameter of the thread 112 that is to be used in conjunction with the open eye needle 110.

In certain embodiments, the width of the eye region 130 may be between about 0.005 and 0.020 inches. In other embodiments, the width of the eye region 130 may be about 0.007 inches.

In certain embodiments, the length of the eye region 130 may be between about 0.005 and 0.030 inches. In other embodiments, the length of the eye region 130 may be about 0.015 inches. In certain embodiments, the length of the eye region 130 is larger than the width of the eye region.

While the open eye portion 120 is illustrated as having a width that is approximately the same as the width of the other portions of the open eye needle 110, it is also possible for the open eye portion 120 to have a width that is greater than the other portions of the open eye needle 110 to enhance the strength of the open eye needle 110.

While the other parts of the open eye needle 110 may be generally cylindrical, the open eye portion 120 may be non-cylindrical. In certain embodiments, areas of the open eye portion 120 may have an oval profile. In certain embodiments, the elongated portion 124 may have a diameter of about 0.028 inches while the open eye portion 120 may have a width of about 0.030 inches and a height of about 0.025 inches.

The open eye portion 120 may comprise between about 5 and 30 percent of the length of the open eye needle 110. In certain embodiments, the open eye portion 120 comprises between about 10 and 15 percent of the length of the open eye needle 110.

The tip portion 122 is tapered to a point 148. A length of the taper and a width of the point 148 may be selected based upon the type of material 114 with which the open eye needle 110 is to be used. For example, when the material 114 is woven fabric having a relatively fine thread count, the point 148 may have a relatively small width.

The tip portion 122 may comprise between about 10 and 30 percent of the length of the open eye needle 110. In certain embodiments, the tip portion 122 comprises between about 15 to 20 percent of the length of the open eye needle 110.

The elongated portion 124 may have a generally cylindrical shape and may be formed with a length that enables the open eye needle 110 to be initially pushed through the material 114 from an upper side of the material 114 and then pulled through the material 114 from a lower side of the material 114. It is possible for the elongated portion 124 to take alternate shapes, examples of which include oval and hexagon.

The elongated portion 124 may comprise between about 50 and 80 percent of the length of the open eye needle 110. In certain embodiments, the elongated portion 124 comprises between about 60 and 70 percent of the length of the open eye needle 110.

The mounting portion 126 may be formed with a shape that generally conforms to a shape of the recess on the sewing machine (not shown) with which the open eye needle 110 is to be used. While the open eye needle 110 is illustrated as having one tip portion 122 attached to the mounting portion 126, it is also possible to configure the open eye needle 110 so that multiple tip portions 122 are attached to a single mounting portion 126. In such a configuration, there would be one open eye portion 120 associated with each tip portion 122.

The open eye needle 110 may be fabricated from a variety of materials, examples of which include metal and plastic. A preferred material for fabricating the open eye needle 110 is stainless steel, which is strong and resists corrosion during use and storage. In certain embodiments, the stainless steel used to fabricate the open eye needle 110 is 174PH and 177PH.

In certain embodiments, the open eye needle 110 is shaped, hardened and sharpened. The open eye needle 110 may also be annealed depending on the material used to fabricate the open eye needle 110. Examples of techniques that may be used to fabricate the open eye needle 110 include stamping, laser, EDM or combinations thereof.

After forming, the open eye needle 110 may be hardened by heating. The temperature and duration needed to achieve hardening of the open eye needle 110 depends on the material used to fabricate the open eye needle 110.

Next, the open eye needle 110 is sharpened. A person of ordinary skill in the art will appreciate that a variety of techniques may be used to sharpen the open eye needle 110 such as grinding and polishing.

Thereafter, one or more coatings may be applied to the surface of the open eye needle 110. Examples of such coatings include titanium on the tip portion 122 to enhance the durability of the tip portion 122, gold plating to the open eye portion 120 to allow the thread to pass through the open eye portion 120 more easily. It is also possible to coat the surface of the open eye needle 110 with nickel. Examples of other coating materials include silicon or similar materials.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An open eye needle comprising:
an elongated portion;
a tip portion attached to the elongated portion; and
an open eye portion attached to the elongated portion, wherein the open eye portion comprises:
a tongue portion;
an eye region defined by the tongue portion; and
a channel that extends around the tongue portion and intersects the eye portion, wherein the channel comprises a first channel portion and a second channel portion that extends from the first channel portion, wherein the first channel portion is oriented at an acute angle with respect to the second channel portion, wherein the second channel portion is in communication with the eye region and wherein the second channel portion is oriented at an obtuse angle with respect to the eye region.

2. The open eye needle of claim 1, wherein the open eye portion has a diameter that is no greater than a diameter of the elongated portion and the tip portion.

3. An open eye needle comprising:
an elongated portion;
a tip portion attached to the elongated portion; and
an open eye portion attached to the elongated portion, wherein the open eye portion comprises:
a tongue portion;
an eye region defined by the tongue portion;
a channel that extends around the tongue portion and intersects the eye portion, wherein the channel comprises a first channel portion and a second channel portion that extends from the first channel portion, wherein the first channel portion is oriented at an acute angle with respect to the second channel portion, wherein the second channel portion is in communication with the eye region; and a wide region intermediate the open eye portion and the tip portion, wherein the wide region has a diameter that is greater than a diameter of the open eye portion and the tip portion.

4. The open eye needle of claim 3, wherein the diameter of the wide region is up to about 30% greater than the diameter of the eye portion and the tip portion.

5. The open eye needle of claim 1, wherein at least a part of the tongue portion is resilient.

6. An open eye needle comprising:

an elongated portion;

a tip portion attached to the elongated portion; and an open eye portion attached to the elongated portion, wherein the open eye portion comprises:

a tongue portion;

an eye region defined by the tongue portion; and a channel that extends around the tongue portion and intersects the eye portion, wherein the channel comprises a first channel portion and a second channel portion that extends from the first channel portion, wherein the first channel portion is oriented at an acute angle with respect to the second channel portion, wherein the second channel portion is in communication with the eye region and wherein an end of the tongue portion is inwardly directed.

7. The open eye needle of claim 1, wherein an angle between the first channel portion and the second channel portion is between about 5° and 45°.

8. The open eye needle of claim 1, wherein the second channel portion is oriented with respect to the eye region at an angle of between about 130° and 170°.

9. The open eye needle of claim 1, and further comprising a tab in the open eye portion, wherein the tab extends towards the tongue portion.

10. The open eye needle of claim 1, wherein the eye region has a generally oval shape.

11. The open eye needle of claim 1, wherein the open eye portion has a generally oval profile.

12. The open eye needle of claim 1, and further comprising a recess formed in at least one surface of the open eye portion proximate to where a thread passes through the open eye portion.

13. The open eye needle of claim 1, and further comprising a mounting portion attached to the elongated portion, wherein the mounting portion facilitates attachment of the open eye needle to a sewing machine.

14. The open eye needle of claim 13, wherein the tongue portion is oriented away from the tip portion.

15. The open eye needle of claim 1, wherein the tip portion, the elongated portion and the open eye portion are fabricated from metal, plastic or combinations thereof.

16. The open eye needle of claim 1, wherein at least the open eye portion is fabricated from 174PH stainless steel, 177PH stainless steel or combination thereof.

* * * * *